US006034451A

United States Patent [19]

El Mayas

[11] Patent Number: 6,034,451

[45] Date of Patent: Mar. 7, 2000

[54] CENTRIFUGAL FAN WITH IMPROVED AIR COOLING FOR ITS MOTOR, ESPECIALLY FOR A MOTOR VEHICLE

[75] Inventor: Jihad El Mayas, Elancourt, France

[73] Assignee: Valeo Climatisation, La Verriere, France

[21] Appl. No.: 09/124,739

[22] Filed: Jul. 29, 1998

[30] Foreign Application Priority Data

Jul. 31, 1997 [FR] France ..... 97 09808

[51] Int. Cl.[7] ..... H02K 7/14; H02K 9/08; F04D 17/04

[52] U.S. Cl. ..... 310/63; 310/58; 417/369; 415/203

[58] Field of Search ..... 310/60 R, 62, 310/63, 58, 59; 415/58.4, 203, 206; 417/423.8, 370, 369

[56] References Cited

U.S. PATENT DOCUMENTS

| | | | |
|---|---|---|---|
| 5,743,721 | 4/1998 | Graham et al. | 415/58.4 |
| 5,744,213 | 4/1998 | Nelson | 428/131 |

FOREIGN PATENT DOCUMENTS

| | | |
|---|---|---|
| 0 499 104 | 8/1992 | European Pat. Off. . |
| 2 327 431 | 5/1977 | France . |
| 2 412 976 | 7/1979 | France . |
| 2 471 503 | 6/1981 | France . |
| 1 560 117 | 1/1980 | United Kingdom . |
| 2 067 665 | 7/1981 | United Kingdom . |

OTHER PUBLICATIONS

Patent Abstracts of Japan, vol. 010, No. 257, Sep. 3, 1986 and JP 61 085214 A (Nissan Motor Co. Ltd; Others: 01), Apr. 30, 1986.

French Search report dated Apr. 30, 1998.

*Primary Examiner*—Nestor Ramirez
*Assistant Examiner*—Judson H. Jones
*Attorney, Agent, or Firm*—Morgan & Finnegan, LLP

[57] ABSTRACT

A centrifugal fan for a motor vehicle has a fan rotor driven in rotation by an electric motor and lodged in a central part of a casing. The outer walls of the casing define, in conjunction with a peripheral portion of the rotor, a volute for channeling air which is delivered by the rotor in a tangential direction. The outer wall of the casing includes a longitudinal side wall portion formed with through apertures constituting diversion ports, for taking off some of the air delivered by the rotor and diverting this air through an external duct fixed to the casing and open into the central region of the latter, so as to cool the motor.

25 Claims, 3 Drawing Sheets

CENTRIFUGAL FAN WITH IMPROVED AIR COOLING FOR ITS MOTOR, ESPECIALLY FOR A MOTOR VEHICLE

FIELD OF THE INVENTION

This invention relates to centrifugal fans, in particular for motor vehicles. More particularly, the invention relates to centrifugal fans of the type comprising a fan rotor which is driven in rotation by an electric motor and mounted in a central region of a casing, with the outer wall of the casing, together with the periphery of the fan rotor, defining a volute for channeling air which is delivered by the fan rotor in a direction tangential to the periphery of the latter.

BACKGROUND OF THE INVENTION

In operation, the motor of such a fan becomes heated. Due to its position within the casing of the fan, it is difficult to cool the motor. In order to overcome this drawback, it has been proposed to equip the casing with a duct for diverting some of the air within the volute, and more particularly into an upper part of the latter, so as to pass it close to the motor. However, this arrangement is not entirely satisfactory, partly because it does not enable enough air to be diverted, and secondly because it gives rise to high turbulence in the region of the volute into which the inlet end of the diversion duct is open.

DISCUSSION OF THE INVENTION

An object of the invention is accordingly to provide a centrifugal fan which, in particular, does not have the disadvantages of known types of such fans as discussed above.

According to the invention, a centrifugal fan, of the type comprising a fan rotor driven in rotation by an electric motor and mounted in a central region of a casing, with an outer wall of which the casing, together with the periphery of the fan rotor, defining a volute for channeling air which is delivered by the fan rotor tangentially to the periphery of the latter, is characterised in that the outer wall of the casing, partly defining the volute, includes a first predetermined lateral zone having diversion ports constituting through apertures of selected dimensions for diverting some of the air delivered by the rotor, whereby to pass the diverted air to a first end of an external diversion duct which is fixed to the said casing and which terminates in a second end which is open into a second predetermined zone of the said central region of the casing, for the purpose of cooling the motor.

With this arrangement, the diverted air is no longer taken off substantially at right angles to the main flow direction within the volute, but is instead taken off tangentially, so that, firstly, air is more easily drawn off for diversion, and secondly, turbulence is minimised or even eliminated. In addition, the volume of air which is diverted can be quite well controlled, due to the fact that the dimensions of the diversion ports can be determined appropriately.

According to a preferred feature of the invention, the first predetermined lateral zone is situated close to the start or inlet end of the volute, in a location where the volute has its smallest cross section. The effectiveness of the diversion is consequently reinforced due to the fact that the mass flow is at its greatest in that region.

In addition, with a view to improving even more the effectiveness of the diversion of air for cooling purposes, the second predetermined zone is arranged in an upper region of the casing, substantially above the fan rotor. This enables advantage to be taken of the suction induced by rotation of the rotor, and this consequently optimises the operation of taking off air for diversion.

In a preferred embodiment of the invention, the said predetermined first zone comprises a portion of the casing outer wall, or side wall portion, which is formed with the diversion ports in the form of through holes, and defines an elbow in the region of the junction between the inlet end and delivery end of the volute, and this elbow is closed by a complementary wall in such a way as to delimit, with the said side wall portion, a cavity which receives the diverted air through the delivery ports, and into which the first end of the diversion duct is open. Thus, this enables the diversion duct to be connected easily to the upper part of the casing, without increasing overall lateral dimensions. In addition, due to the location of the diversion ports, and due also to the suction effect noted above, the air which is blown to the inlet end of the volute no longer has a tendency to mix with that which is expelled through its delivery end, so that the boundary layer of air which forms in the region of the bend no longer has any tendency to separate. This leads to a very marked reduction in the noise produced by the fan.

Preferably, the complementary wall and the side wall portion that includes the diversion ports are formed in one piece with each other. The outer walls of the casing, and the cavity, can thus be formed by moulding in a synthetic material.

The delivery ports may be made in the form of substantially circular holes and/or substantially oblong slots.

According to a further preferred feature of the invention, the fan further includes an additional external diversion duct, this additional duct having opposed ends, one of which is open into the volute (preferably into a portion of the latter in which the volute is of maximum cross section), the other end being open into the central part of the casing in the region of the motor. This enables the volume of air diverted to be increased where the motor so requires.

Further features and advantages of the invention will appear more clearly on a reading of the following detailed description of some preferred embodiments of the invention, which are given by way of non-limiting example only and with reference to the accompanying drawings.

DESCRIPTION OF PREFERRED EMBODIMENTS OF THE INVENTION

Figure 1:
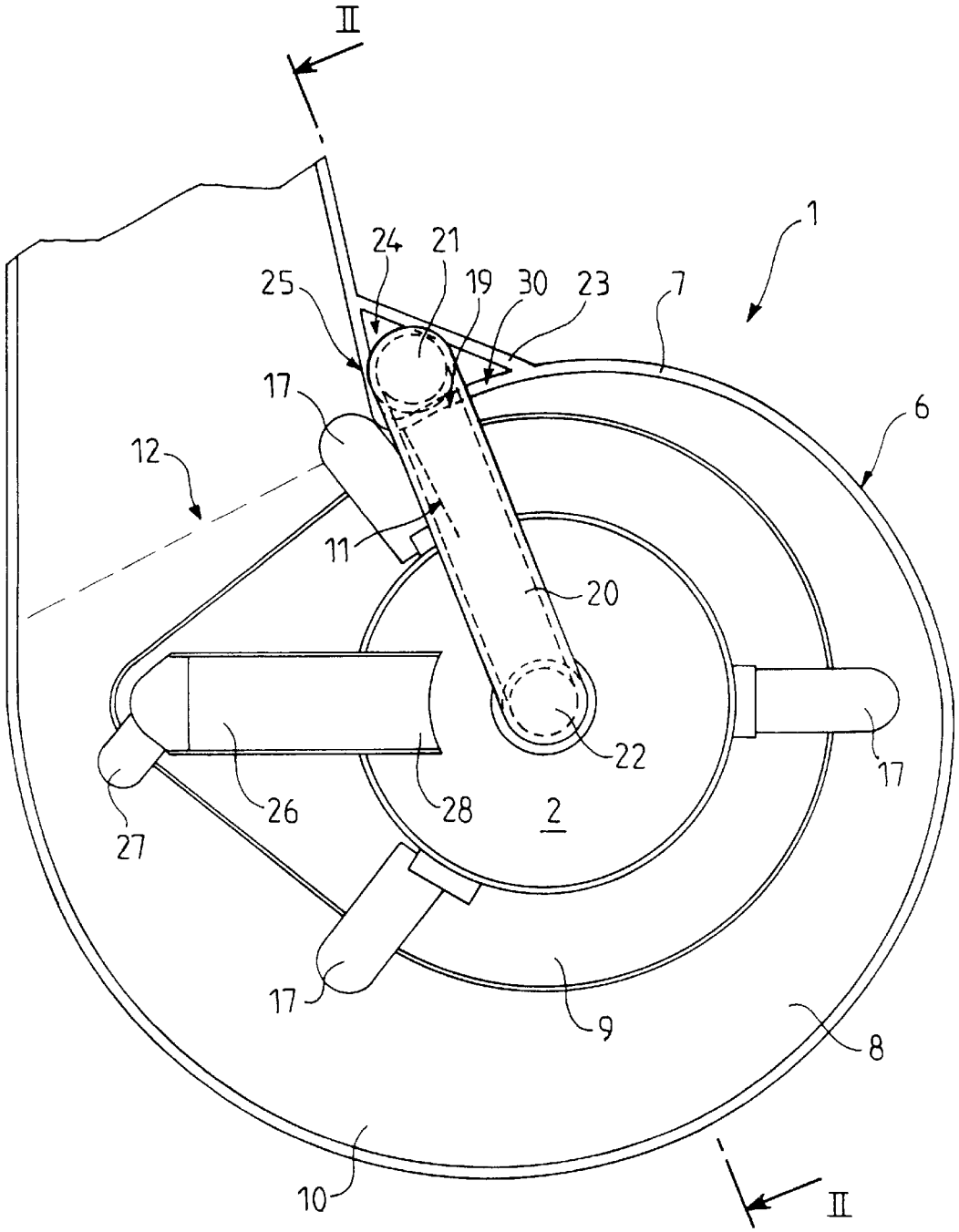
FIG. 1 is a top plan view of a centrifugal fan in accordance with the invention.
Figure 2:
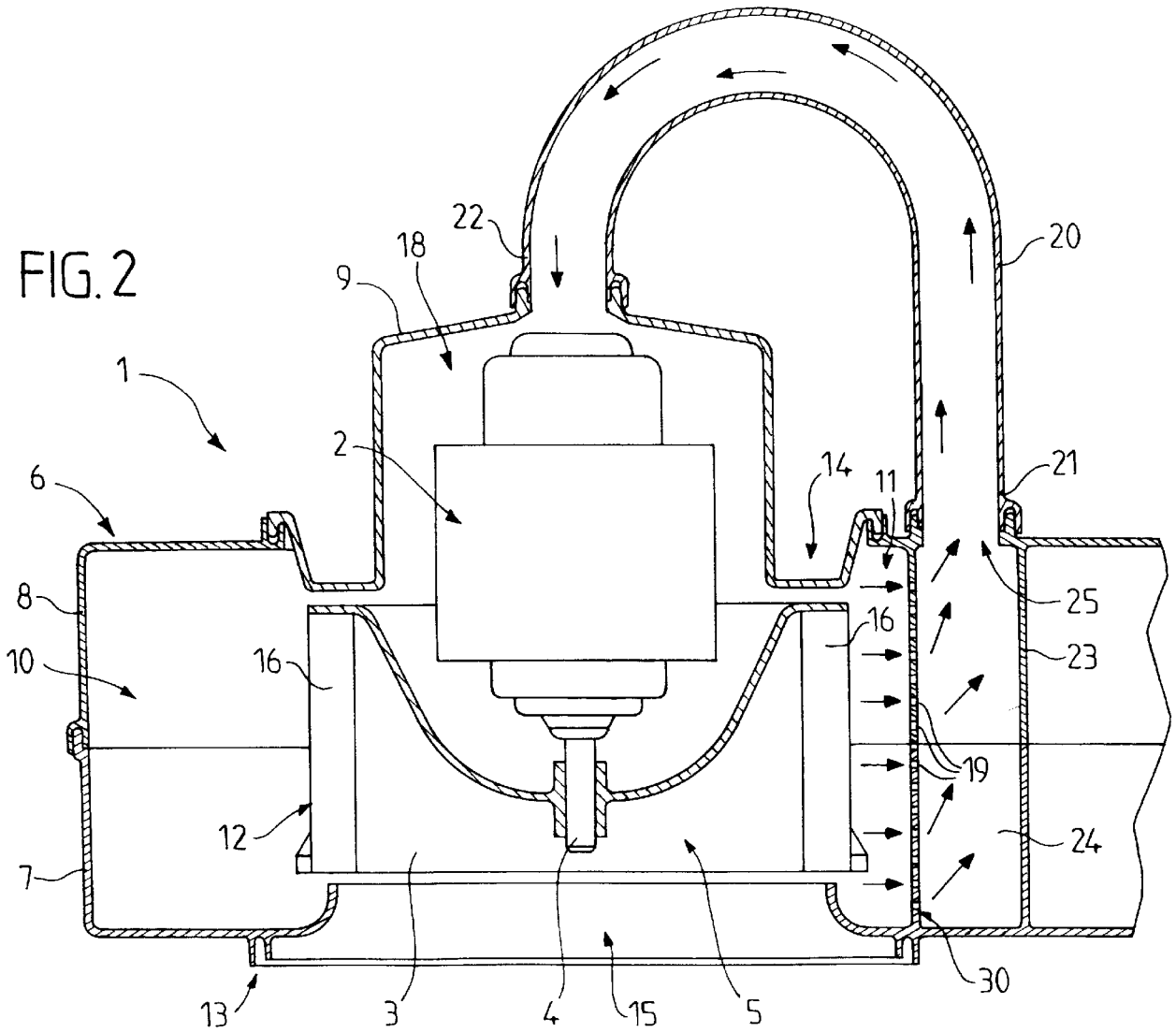
FIG. 2 is a view in cross section taken on the line II—II in FIG. 1.

Reference is first made to FIGS. 1 and 2, which show a centrifugal fan 1 which is for example intended to deliver blown air to an air distribution and treatment unit in a heating and/or air conditioning installation for a motor vehicle.

The centrifugal fan 1 has a casing 6 and comprises an electric motor 2 which drives a fan rotor 3 in rotation about an axis of revolution defined by a motor shaft 4, which then defines the longitudinal direction of the fan. The electric motor 2 is controlled by a control module (not shown) which governs the level of voltage or current supplied to the motor, and which in consequence controls the speed of rotation of the fan rotor 3.

The electric motor 2 and the fan rotor 3 are mounted in a central region 5 of the casing 6, the outer wall of which partly defines a spiral volute 10. The cross section of the volute 10 increases from its inlet end 11 to its delivery end 12. The volute 10 extends around the central region 5 of the casing, and is in fact bounded by the outer wall of the casing and by the periphery 12' of the fan rotor 3.

In the embodiment shown in FIG. 2, the casing 6 consists of three parts 7 to 9, which are assembled together. The first casing part 7 defines the base or lower portion 13 of the volute 10, together with at least part of the longitudinal side edges of the latter. The second casing part 8 is fitted over the first part 7. The second casing part 8 has a central aperture 14 which contains part of the electric motor 2. The third casing part 9 defines a chamber 18 which surrounds the upper part of the electric motor 2. The third casing part 9 cooperates with the first and second casing parts 7 and 8 in the aperture 14, so as to constitute a sealed protective cover of the casing 6.

The first part 7 of the casing 6 includes, in its lower portion 13 and in line with the central region 5 of the casing, an aperture 15 which is a suction port, through which air is drawn axially (or longitudinally) by the fan rotor 3.

In its peripheral portion 12', the fan rotor 3 is formed with longitudinal apertures 16 through which, when the fan is rotating, the air drawn in through the suction port 15 is expelled substantially tangentially into the volute 10, between the inlet end 11 and the delivery end 12 of the latter.

The third casing part or cover, 9, may typically be secured on the first and second casing parts 7 and 8 by means of fastening lugs 17, of which there are three in this example as shown in FIG. 1.

When the motor 2 is operating, it becomes heated. Because of the small size of the chamber 18 in which the motor is at least partially contained within the third casing part 9, the motor is not able to be effectively cooled under all conditions. As a result, the motor 2 can become damaged under certain operating conditions, especially when it is required to work at full power for extended periods of time. In order to overcome this disadvantage, the centrifugal fan 1 includes means for diverting some of the air from the volute 10. More precisely, these diversion means comprise through holes constituting diversion ports 19, which are formed in a longitudinally extending side wall portion 30 of the outer wall of the casing. In this example, these diversion ports 19 are formed in the side wall of the first and second parts 7 and 8 of the casing. The diversion ports 19 divert a fraction of the air delivered by the fan rotor 3 towards a main air diversion duct 20, which is secured to the casing 6 at a first end 21 and a second end 22 of the duct 20.

In the example shown in FIG. 2, the first end 21 of the main air diversion duct 20 is joined to the second part 8 of the casing, while its second end 22 is joined to the third part 9 of the casing, preferably in a position which is centred, as shown, in the central region 5 of the casing substantially above the electric motor 2.

Preferably, the casing 6 also includes a complementary wall 23 which defines a cavity 24 with the longitudinal side wall portion 30 in which the air diversion ports 19 are formed. The casing 6 also has an upwardly directed distribution or outlet aperture 25, the dimensions of which are matched to those of the first end 21 of the air diversion duct 20, so that the air from the cavity 24 is passed only into the duct 20. The complementary wall 23 and the longitudinal side wall portion 30 are preferably formed integrally with each other.

Figure 3A:
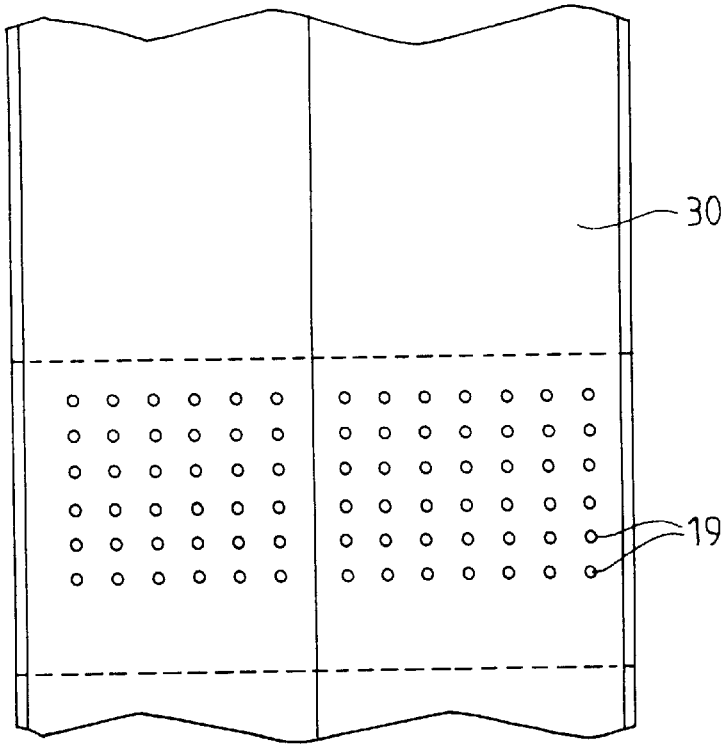
FIG. 3A shows diagrammatically one form of the diversion ports.
Figure 3B:
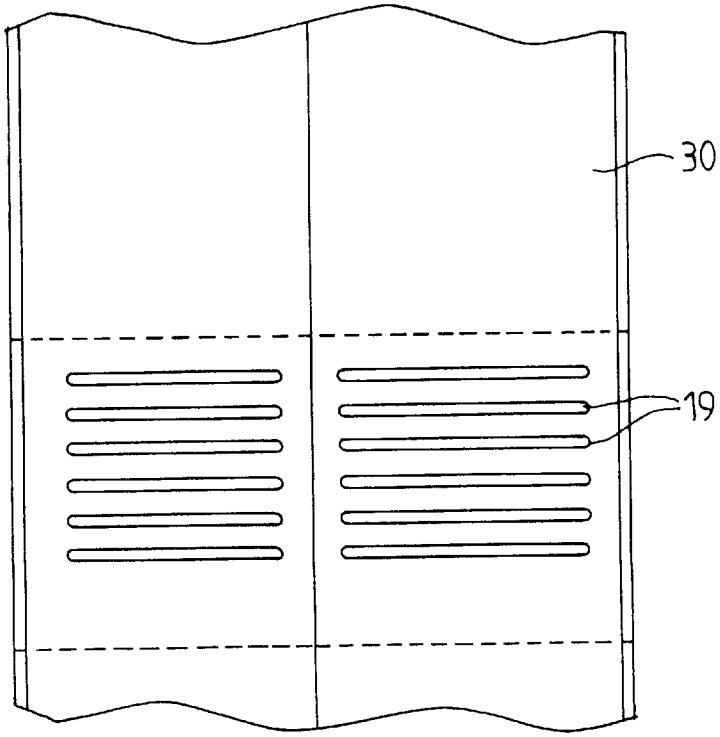
FIG. 3B is a view similar to FIG. 3A, but showing another form of the diversion ports.

With reference now to FIGS. 3A and 3B, the diversion ports 19 formed in the longitudinal side wall portion which partly bounds the cavity 24 may take various forms. The dimensions of these ports will be so chosen as to enable a sufficiently high volume of air to be diverted to give proper cooling of the electric motor 2. In other words, the dimensions of the diversion ports will be selected, firstly according to the characteristics of the electric motor 2, and secondly according to the dimensions of the cavity 18 in which the motor is housed. In preferred forms of the invention, the through ports 19 are made in the form of substantially circular holes as in FIG. 3A, or substantially oblong slots as in FIG. 3B. However, a combination of holes and slots may be envisaged, or again the ports may take any other desired form.

In order firstly to optimise the diversion of air for cooling the motor, the through ports 19, and in consequence, in this example, the cavity 24, or collection chamber, for the diverted air, lie close to the inlet end 11 of the volute 10, in the region of the latter in which it has a minimal cross section, this being where, in consequence, the mass flow of the air delivered by the fan is greatest.

Because the through apertures 19 are formed in a longitudinally extending side 30 of the casing outer wall defining the volute 10, the air which is expelled tangentially from the fan rotor 3 impinges obliquely on the side wall portion 30, so that this air is able to enter the collection chamber 24 without disturbing the flow of the remainder of the air delivered into the volute 10. This has the result that turbulence due to aspiration of the air is avoided.

The volume of air which is diverted through the duct 20 is optimised still further by virtue of the position of the junction between the second end 22 of the duct 20 and the chamber 18 which contains the electric motor 2. In this connection, when the fan rotor 3 is put into rotation, suction is set up in the chamber 18. This favours, firstly the flow of the diverted air from the collection chamber 24 to the second end 22 of the duct 20, and secondly the volume of air drawn through the diversion ports 19.

A further particular advantage of putting the collection chamber 24 close to the inlet end 11 of the volute 10 is that, in this region, the outer side wall portion 30 of the casing 6 defines an elbow as shown in FIG. 1. In the region of this elbow, containing the outlet aperture 25, a zone of communication between the inlet end 11 and delivery end 12 of the volute is formed. Turbulence can occur in this zone, thus giving rise to separation of the air boundary layer which forms generally in the region of the delivery end 12 of the volute. In centrifugal fans as currently known in the prior art, this separation of the boundary layer gives rise to noise which can be detrimental to the comfort of the users.

Sometimes, due to the positioning of the through holes or diversion ports 19, the air expelled by the fan rotor 3 into the volute 10 is constrained, either to flow within the volute, from its lower cross section to its high cross section, or to penetrate into the collection chamber 24. As a result, the expelled air no longer tends to disturb the air that reaches the delivery end 12 of the volute.

As is shown in FIG. 1, an additional air delivery duct 26 may also be provided. This duct 26 has a first end 27 which is open into the volute 10, and more precisely into an upper region of the second casing part 8, in a zone of the volute having a high cross section; and a second end 28 which is open into the middle of the third casing part 9. This enables the amount of air diverted to be increased where called for by the characteristics of the electric motor 2.

Preferably the various parts of the casing are formed of synthetic materials, typically plastics material, and are for example in the form of mouldings.

The invention is not limited to the embodiment described above by way of example only, but it embraces all variants which could be conceived or developed by a person skilled in this technical field, within the scope of the Claims of this Application. Thus for example, the position of the diversion ports may be slightly spaced away from the inlet end 11 of the volute.

In addition, an embodiment has been described above in which the main air diversion duct is fed through a collection chamber or cavity, but it will be clearly understood that the duct may be fed directly through the diversion ports.

What is claimed is:

1. A centrifugal fan comprising:

a casing having an outer wall and a central region;

an electric motor in said central region of the casing;

a fan rotor in said central region of the casing, said rotor being coupled to the motor to be driven by the motor and having a peripheral portion, the outer wall of the casing and the peripheral portion of the fan rotor together defining a volute within the casing for channeling air delivered by the fan rotor in a direction tangential to the peripheral portion of the fan rotor, the volute having an inlet end and a minimum cross section at said inlet end, wherein said outer casing wall defining the volute defines a first predetermined lateral zone and through apertures, constituting diversion ports, formed in the first zone to selected dimensions, for taking off some of the air delivered by the fan rotor, the first zone being close to the inlet end of the volute, the casing defining a predetermined second zone in said central region, the fan further including a diversion duct outside the casing, the diversion duct having a first end fixed to the casing and in communication with the diversion ports, for receiving air delivered through the diversion ports, and a second end fixed to the casing and open in said second zone, wherein air, diverted from the volute through the diversion ports and the diversion duct to the central region of the casing, cools the motor.

2. A fan according to claim 1, wherein the casing has an upper region substantially above the motor and fan rotor and subject to suction of air by the rotor, the second zone being in the upper region of the casing.

3. A fan according to claim 1, the casing defining an inlet end and a delivery end of the volute and a junction between the ends of the volute, said first zone comprising a side portion of the casing wall, said side wall portion being formed with the diversion ports and defining an elbow in the region of the junction, the fan further including a complementary wall closing the bend of the elbow and defining a collection chamber for diverted air, the collection chamber being open through the diversion ports so as to receive air through the diversion ports, and the first end of the diversion duct being open into the collection chamber.

4. A fan according to claim 3, wherein the complementary wall and the outer wall bounding the volute are formed integrally with each other.

5. A fan according to claim 1, wherein the diversion ports are substantially circular holes.

6. A fan according to claim 1, wherein the diversion ports are substantially oblong slots.

7. A fan according to claim 1, wherein the casing is molded in a synthetic material.

8. A motor vehicle having a centrifugal fan according to claim 1.

9. A centrifugal fan comprising:

a casing having an outer wall and a central region;

an electric motor in said central region of the casing;

a fan rotor in said central region of the casing, said rotor being coupled to the motor to be driven by the motor and having a peripheral portion, the outer wall of the casing and the peripheral portion of the fan rotor together defining a volute within the casing for channeling air delivered by the fan rotor in a direction tangential to the peripheral portion of the fan rotor, wherein said outer casing wall defining the volute defines a first predetermined lateral zone and through apertures, constituting diversion ports, formed in the first zone to selected dimensions, for taking off some of the air delivered by the fan rotor, the casing defining, a predetermined second zone in said central region, the fan further including a diversion duct outside the casing, the diversion duct having a first end fixed to the casing and in communication with the diversion ports, for receiving air delivered through the diversion ports, and a second end fixed to the casing and open in said second zone, wherein air, diverted from the volute through the diversion ports and the diversion duct to the central region of the casing, cools the motor; and an additional external diversion duct having a first end open into the volute and a second end open into the central region of the casing in the vicinity of the motor.

10. An apparatus comprising:

a casing having an outer wall and a central region;

an electric motor in said central region of the casing;

a fan rotor in said central region of the casing being coupled to the motor to be driven by the motor and having a peripheral portion, wherein said peripheral portion of the fan rotor and said outer wall of the casing define a volute within the casing for channeling air delivered by the fan rotor in a direction tangential to the peripheral portion of the fan rotor, the volute having an inlet end and a minimum cross section at said inlet end, wherein said outer casing wall defining a volute defines a first predetermined lateral zone and diversion ports formed in the first zone for taking off some of the air delivered by the fan rotor, the first zone being close to the inlet end of the volute, and the casing defining a predetermined second zone in said central region; and a diversion duct outside the casing, the diversion duct having a first end fixed to the casing and in communication with the diversion port, for receiving air delivered through the diversion ports, and a second end wherein air, diverted from the volute through the diversion ports and the diversion duct to the central region of the casing, cools the motor.

11. A apparatus according to claim 10, wherein the casing has an upper region subject to suction of air by the rotor, the second zone being in the upper region of the casing.

12. A apparatus according to claim 10, wherein the casing defines an inlet end and a delivery end of the volute and a junction between the ends of the volute.

13. A apparatus according to claim 10, wherein the first zone comprises a side wall portion of the casing wall, said side wall portion being formed with the diversion ports and defining an elbow in the region of the junction.

14. A apparatus according to claim 10, wherein the fan further includes a complementary wall closing the bend and defining a collection chamber for diverted air.

15. A apparatus according to claim 10, wherein the collection chamber opens to the diversion ports so as to receive air from the volute, and the first end of the diversion duct being open into the collection chamber.

16. A apparatus according to claim 10, wherein the complementary wall and the outer wall bounding the volute are formed integrally with each other.

17. A apparatus according to claim 10, wherein the diversion ports are substantially circular holes.

18. A apparatus according to claim 10, wherein the diversion ports are substantially oblong slots.

19. A apparatus according to claim 10, wherein the casing is molded in a synthetic material.

20. An apparatus comprising:

a casing having an outer wall and a central region;

an electric motor in said central region of the casing;

a fan rotor in said central region of the casing being coupled to the motor to be driven by the motor and having a peripheral portion, wherein said peripheral portion of the fan rotor and said outer wall of the casing define a volute within the casing for channeling air delivered by the fan rotor in a direction tangential to its peripheral portion, wherein said outer casing wall defining a volute defines a first predetermined lateral zone and diversion ports formed in the first zone for taking off some of the air delivered by the fan rotor and the casing defining a predetermined second zone in said central region;

a diversion duct outside the casing, the diversion duct having a first end fixed to the casing and in communication with the diversion ports, for receiving air delivered through the diversion ports, and a second end wherein air, diverted from the volute through the diversion ports and the diversion duct to the central region of the casing, cools the motor; and an additional external diversion duct having a first end open into the volute and a second end open into the central region of the casing in the vicinity of the motor.

21. A centrifugal fan comprising:

a casing having an outer wall, a central region, a first casing part, a second casing part attached to the first casing part, a third casing part attached to the second casing part and defining a chamber within the central region, a side wall portion having a plurality of diversion ports, and a complementary wall, said side wall portion and said complementary wall are integrally formed and together define a cavity;

an electric motor in said central region of the casing, said chamber of the third casing part of the casing substantially above the motor;

a fan rotor in said central region of the casing being coupled to the motor to be driven by the motor and having a peripheral portion, wherein said peripheral portion of the fan rotor and said outer wall of the casing together define a volute, within the casing for channeling air delivered by the fan rotor in a direction tangential to its peripheral portion, said casing defines an inlet end and a delivery end of the volute, wherein said outer casing wall defining the volute defines a first predetermined lateral zone near the inlet end and side wall portion of the casing, for taking off some of the air delivered by the fan rotor; and a diversion duct outside the casing, the diversion duct having a first end fixed to the casing and open to the cavity defined by the side wall and the complementary wall for receiving air delivered through the diversion ports from the fan rotor, and a second end fixed to the third casing part of the casing and open to the chamber defined by the third casing part, wherein air, diverted through the diversion ports and suctioned through the diversion duct into the chamber of the third casing part of the casing by the fan rotor, enters to cool the motor.

22. A fan according to claim 21, further including an additional external diversion duct having a first end open into the volute and a second end open into the central region of the casing in the vicinity of the motor.

23. A method of cooling an electric motor of a centrifugal fan comprising:

channeling air from a fan rotor through diversion ports in a casing located near a first predetermined lateral zone, the casing having an outer wall, the outer wall of the casing and a peripheral portion of the rotor together defining a volute, the volute having an inlet end and a minimum cross section at said inlet end, the first predetermined lateral zone being close to the inlet end of the volute;

receiving the air channeled through the diversion ports in a cavity;

suctioning the air, caused by the movement of the fan rotor, from the cavity through a diversion duct and into a chamber surrounding the electric motor in the casing; and cooling the electric motor in the chamber surrounding the electric motor.

24. An apparatus comprising:

means for channeling air from a fan rotor near a first predetermined lateral zone;

means for receiving the air from the channeling means near the first predetermined zone;

means for delivering the air in the receiving means from the channeling means near the first predetermined zone to an electric motor;

means for channeling air from the fan rotor near a second predetermined lateral zone;

means for receiving the air from the channeling means near the second predetermined zone;

means for delivering the air in the receiving means from the channeling means near the second predetermined zone to the electric motor; and means for cooling the electric motor with the air from both the first predetermined lateral zone and the second predetermined lateral zone.

25. A centrifugal fan comprising:

means for channeling air from a fan rotor through diversion ports in a casing located near a first predetermined lateral zone, the casing having an outer wall, the outer wall of the casing and a peripheral portion of the rotor together defining a volute, the volute having an inlet end and a minimum cross section at said inlet end, the first predetermined lateral zone being close to the inlet end of the volute;

means for receiving the air from the channeling means;

means for delivering the air in the receiving means to an electric motor through a diversion duct outside the casing; and means for cooling the electric motor in a chamber surrounding the electric motor.

* * * * *